United States Patent [19]

Cohen

[11] 3,984,034

[45] Oct. 5, 1976

[54] FLUID AND PASTE DISPENSER

[76] Inventor: Milton J. Cohen, 9201 Persimmon Tree Road, Potomac, Md. 20854

[22] Filed: Oct. 29, 1974

[21] Appl. No.: 518,670

Related U.S. Application Data

[63] Continuation of Ser. No. 387,707, Aug. 13, 1973, abandoned, Continuation-in-part of Ser. No. 308,548, Nov. 21, 1972, abandoned.

[52] U.S. Cl. ..... 222/389

[51] Int. Cl.[2] ..... B67D 5/54

[58] Field of Search ..... 222/386.5, 387, 389, 222/5, 95, 105

[56] References Cited

UNITED STATES PATENTS

| | | | |
|---|---|---|---|
| 1,303,845 | 5/1919 | Blair | 222/387 X |
| 2,373,774 | 4/1945 | Murnane | 222/83 |
| 3,391,829 | 7/1968 | Gregory | 222/95 |
| 3,471,059 | 10/1969 | Moller et al. | 222/95 |
| 3,482,738 | 12/1969 | Bartels | 222/95 |
| 3,731,854 | 5/1973 | Casey | 222/386.5 |

*Primary Examiner*—Allen N. Knowles
*Assistant Examiner*—Norman L. Stack, Jr.
*Attorney, Agent, or Firm*—McDougall, Hersh & Scott

[57] ABSTRACT

A non-aerosol type fluid and paste dispenser wherein the fluid is contained within a housing which is sealed at the bottom and is provided with a dispensing valve at the top, which includes a piston member within the housing which engages the walls of the housing in sealing relation and which is axially movable between a raised position and a lowered position within the housing to compress the gases between the piston member and the bottom wall of the housing with means for releasably latching the piston member in its lowered position, said piston means pressurizing the fluid or paste in the portion of the housing between the piston and the valve upon release of the piston when in its lowered position of adjustment.

1 Claim, 6 Drawing Figures

FLUID AND PASTE DISPENSER

This is a continuation, of application Ser. No. 387,707, filed Aug. 13, 1973 now abandoned which is a continuation-in-part of Ser. No. 308,548 filed Nov. 21, 1972 and also now abandoned.

This invention relates to a non-aerosol type fluid or paste dispenser, which makes use of mechanical pressure generated by a flexible bag for ejection of the paste or fluid in response to release by a manually operable valve.

In the aforementioned copending application, description is made of a rigid dispensing container having a flexible diaphragm secured at its periphery to the open upper end of the container. The container is subsequently sealed by a closure fitted with a dispensing valve. The diaphragm is stretched to substantially line the inner wall of the container and it is retained in the stretched condition by a latching means provided in the bottom wall of the container, releasably to trip an element projecting from the bottom side of the diaphragm when the diaphragm is in stretched position.

Fluid or paste material, to be dispensed from the container, is introduced into the interior of the stretched diaphragm through the open upper end of the container, in an amount substantially to fill the container. Thereafter, the cover is mounted in sealed relation to close the upper end of the container, to complete the dispensing package in which the fluid or paste to be dispensed is housed in sealed relation within the container but without subjecting the material to pressure.

The filled container can be stored, shipped or displayed in the pressureless state thereby to avoid loss due to leakage, marring the appearance of the container due to leakage of content material, or danger of explosion due to internal pressure.

When it is desired to place the container into operation for dispensing content material, the latch is operated from the outside to release its grip on the diaphragm thereby to release the stretched diaphragm for normal return to its relaxed position. Thus the diaphragm becomes effective to impose pressure on the fluid or paste contained therein whereby such fluid or paste is ejected from the container in response to the operation of the valve and in amounts controlled thereby.

It is an object of this invention to provide improvement in a dispenser of the type described in which the pressure is provided from the compression of gases entrapped within the container, primarily as an incident to the loading operation.

Another object of this invention is to produce a non-aerosol, pressurized fluid and paste dispenser of the type described in which use is made of fluid means for pressurizing the container immediately prior to use so that the completed package, prior to use, is without pressure during storage, shipment or display.

These and other objects and advantages of this invention will hereinafter appear and for purposes of illustration, but not of limitation, an embodiment of the invention is shown in the accompanying drawings in which FIG. 1 is a sectional elevational view of the housing portion of the dispenser container at the beginning of the loading operation;

FIG. 6 is a sectional elevational view similar to that of FIG. 4 in which use is made of the piston of FIGS. 1–3.

Figure 1:
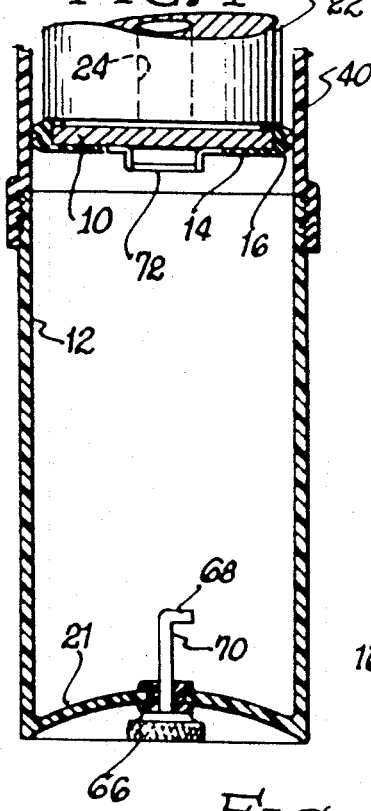

In the modification shown in FIGS. 1–5, instead of making use of a stretchable diaphragm as the pressure generating means for dispensing fluid or paste from within the stretched diaphragm, use is made of a piston member 10 having a cross section corresponding to the interior cross section of the rigid housing 12 and dimensioned to engage the inner walls of the housing all around in sealing relation. For this purpose, the piston member 10 comprises a rigid member formed of metal, plastics, laminate or the like material, having a peripheral portion 14 formed of a resilient material adapted to engage the adjacent walls of the housing in sealing relation while permitting relative sliding movement in the lengthwise direction. For this purpose, the peripheral portion of the piston member may be formed with spaced ribs 16 in sliding engagement with the adjacent walls of the container.

As described in the aforementioned copending application, the piston is provided with means on the bottom side adapted releasably to be latched by a gripping means in the bottom wall of the housing and which is adapted to be operated from outside of the housing to release its grip and free the piston for relative movement. As described in the aforementioned copending application, the open top end of the housing is adapted to be closed by a top wall in the form of a cover 18 provided, in pre-assembly, with a dispensing valve 20 and which is secured in sealing relation onto the open end of the housing after the housing has been filled with content material to be dispensed, such as a fluid or paste. As described in the aforementioned copending application, the closure can be secured as by screwing the cap onto the housing by means of interengaging screw threads provided on the adjacent walls.

Figure 2:
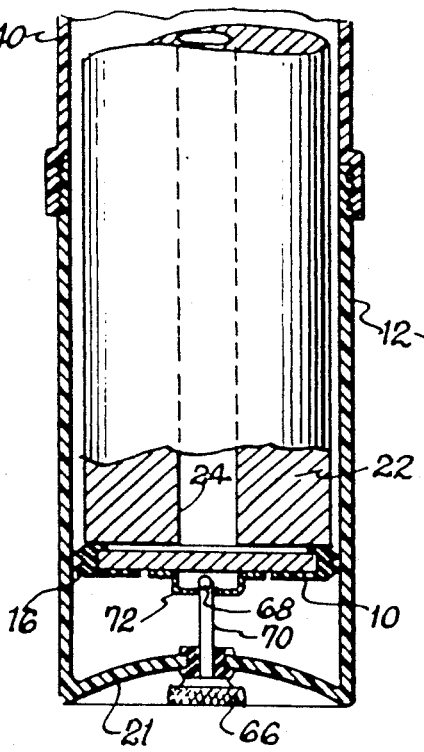
FIG. 2 is a sectional elevational view similar to that of FIG. 1 showing the elements upon completion of the pressurizing step, immediately prior to loading.
Figure 3:
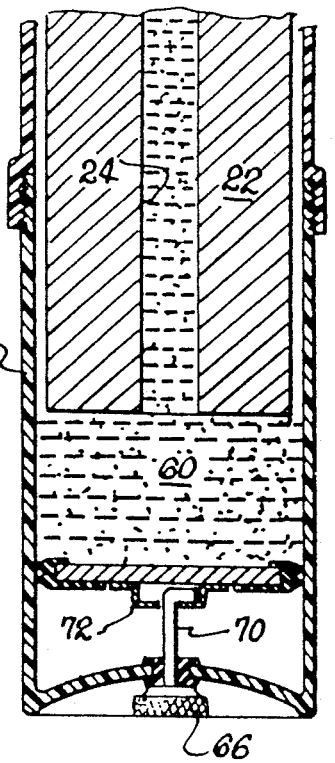
FIG. 3 is a sectional elevational view similar to that of FIGS. 1 and 2, showing the arrangement of elements during loading.

In the modification shown in FIGS. 1–3, the pressure is built up between the underside of the piston 10 and the bottom wall 21 of the housing in response to compression of air entrapped within the housing as the piston 10 is forcibly displaced from the upper end portion of the housing lengthwise to loading position in the bottom end portion of the housing. This can be accomplished by means of a ram 22, while the housing is supported in a suitable jig, not shown.

The piston member 10 is adapted to be restrained from return movement in response to the pressure built up against the underside by a latching means which is activated to latching position in response to displacement of the piston to its loading position of adjustment. While in this position, the housing can be loaded to fill the space above the piston member. The content material can merely be poured into the housing since there is no problem raised by the presence of pressure within the area in which the content material is received or a filled flexible bag can be dropped into the empty area. After the loading operation has been completed, the closure is applied in sealing engagement to close the open top end of the housing to complete the dispensing package.

Under these conditions, the package can be stored, transported and displayed without the content material being under positive pressure, as in an aerosol type dispensing package.

When it is desirable to provide for pressurized dispensing of the content material, in amounts controlled by operation of the dispensing valve, it is only necessary to actuate the latching means to release the grip on the piston member whereby the compressed gases become effective from within to urge the return of the piston member towards raised position in the housing, thereby to pressurize the content material. In order to enhance the dispensing operation and to provide for more complete recovery of content material from within the dispenser, it is desirable to maintain the material under positive pressure, even though the piston is near the end of its pressurized travel. This can be accomplished in a number of ways embodying an improvement of this invention.

In one system, shown in FIGS. 1–3, use is made of a cylinder 40 in the form of a tubular member having a bore size and shape which is the same as the interior of the housing with the tubular member being releasably secured to the open end of the housing to form an aligned extension thereof. Instead of initiating movement of the piston 10 from the upper end of the housing 12, the piston 10 is initially located within the extension 40 so that a greater volume of air will be entrapped for compression as the piston is displaced by the ram to loading position in the bottom end portion of the housing. Thus the amount of air compressed will tend to push the piston beyond the upper end of the housing whereby a pressurized state will continue to exist even after the content material has been exhausted from the container.

Figure 4:
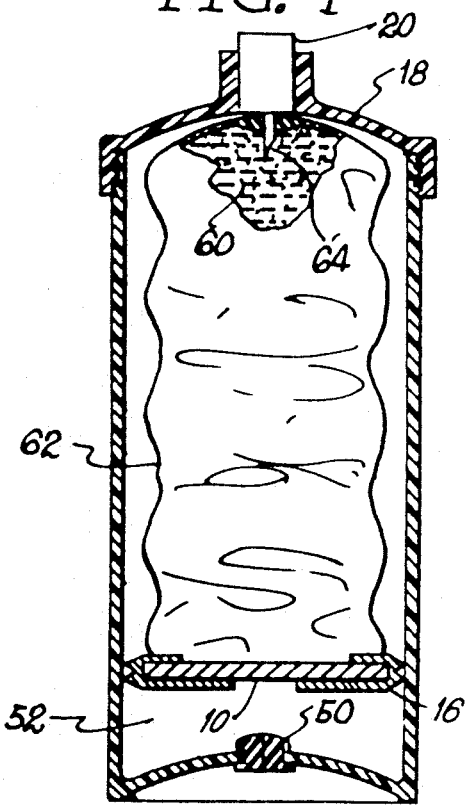
FIG. 4 is a sectional elevational view of the completed package embodying a modification of this invention.

Instead, or in addition thereto, valve means 50, shown in FIG. 4, may be provided in the bottom wall of the container for the introduction of air or other gas under pressure into the area 52 between the piston member 10 and the bottom wall 21. Such addition may be made by an air pump or by means of a cartridge of a pressurized gas or fluid, as will hereinafter be described with reference to FIGS. 4 and 5.

As in the modification described in the copending application, the fluid or paste content material can be poured into the container after the ram is withdrawn and while the piston is latched in loading position. In the preferred practice, illustrated in FIGS. 1–3, the ram 22 is in the form of an elongate member having an axial passage 24 extending continuously substantially throughout the length thereof with the upper end of the passage communicating with a suitable spigot for flowing the content material through the passage in the ram to fill the space vacated by the ram as it is withdrawn from within the housing thereby to provide smooth and controlled filling as the space is made available by the actuating ram.

When filled, the housing is disengaged from the extension and the closure is assembled onto the open end to complete the package with the content material free of pressure until the piston member is released.

Figure 5:
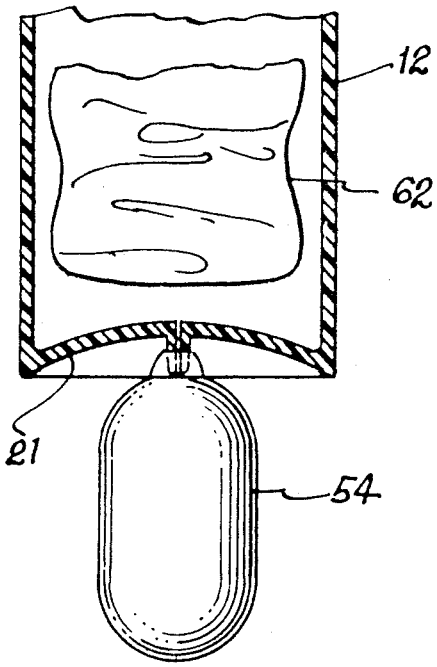
FIG. 5 is a sectional elevational view of the bottom end portion of the assembly shown in FIG. 4, but with a modification in the pressurizing means.

In the modification shown in FIGS. 4 and 5, the content material 60 is provided in a pre-filled cartridge 62 which is separately packaged for loading the dispenser or for use as a refillable cartridge for reloading the dispenser after the empty cartridge has been removed.

In this modification, the closure should be a removable closure so that the top can be removed to expose the open end of the housing for removal of the spent cartridge and for replacement with a new cartridge. Communication between the fluid or paste material within the cartridge and the valve is effected by means of a hollow tubular member having one end communicating with the valve while the other end is in communication with the content material within the cartridge. For this purpose, the other end is pointed, as in a needle, to facilitate piercing the bag and the tubular member is dimensioned to have a length sufficient to extend from the valve into the bag when the closure is assembled in position of use on the end of the housing.

The cartridge 62 is in the form of a bag of collapsible material, such as a bag with foldable side walls, as in an accordion, or with side walls formed of a flexible, rubber-like material, such as natural rubber, synthetic rubber, or flexible plastic, as represented by polyethylene, polypropylene, polyester and the like.

In this construction, the piston member is adapted to be freely slidable within the housing without the need for a tight sealing engagement with the walls of the housing. Since no pressure conditions arise in response to movement of the piston to its lowered position within the housing, means for releasably engaging the piston to seal it in its lowered position is not necessary. Thus, in practice, the piston member 10 is merely displaced to lowered position, the cartridge is inserted into the housing through the open upper end and the closure is screwed into place to close the upper end as the tubular member pierces the cartridge and enters into communication with the content material.

Valve means 50 are provided in the bottom wall for the introduction of pressurizing gas or fluid. Means, such as a conventional tire valve, can be provided in the bottom wall through which air can be pumped into the space within the housing surrounding the bag. For this purpose, use can be made of a tire pump, hand pump, or a cartridge 54 of Freon gas and the like pressurizing material which can be transferred through the valve, as shown in FIG. 5, for introduction into the interior of the container.

Thus the bag 62 is placed under pressure immediately prior to use. When empty, the bag 62 can be removed and replaced with a new filled bag and the container repressurized with air introduced into the container. The refilling can be repeated any number of times to make use of the same container and valve. The amount of pressure can be sufficient to effect only partial dispensing of the content material or all of it. If sufficient for only dispensing a portion, the interior of the container can be repressurized in the manner prescribed to provide for completely exhausting the content material from the bag.

When, on the other hand, the piston member 10 is in tight sealing engagement with the interior walls of the housing, as illustrated in FIG. 6, the pressure gases introduced will be confined in the area between the piston and the bottom wall so that use can be made of a rupturable bag or cartridge and the tubular member 64 connecting the interior of the bag with the dispensing valve can be omitted.

It will be understood that when use is made of latching means operable through the bottom wall of the housing, a sealing relationship is maintained therebetween to prevent escapement of pressurized gas. For this purpose, use can be made of a latching means in the form of a knob 66 mounted for rotational movement with a hook portion 68 on the end of the rod 70 extending into the interior of the housing for hooking engagement with a bracket 72 on the bottom side of the piston member.

It will be understood that changes may be made in the details of construction, arrangement and operation, without departing from the spirit of the invention, especially as defined in the following claims.

I claim:

1. In a fluid and paste dispenser comprising an elongate rigid housing sealed at its top and bottom sides by a top and bottom wall, a dispensing valve in the top wall, a disc plate mounted for independent axial movement within the housing between an original raised and lowered filled positions of adjustment and extending into sealed engagement with the walls of the housing whereby gases confined between the disc plate and the bottom wall are compressed responsive to movement of the disc plate from raised to lowered position, means for releasably latching the disc plate when in its lowered position of adjustment, a collapsible bag containing the fluid or paste material to be dispensed, said bag being dimensioned to be received within the housing in the space above the disc plate, and in which the dispensing valve comprises a hollow shaft extending from the valve into the interior of the housing and dimensioned to have a length to pierce the bag for communicating the fluid or paste material within the bag with the dispensing valve.

* * * * *

UNITED STATES PATENT OFFICE

CERTIFICATE OF CORRECTION

Patent No. 3,984,034 Dated October 5, 1976

Inventor(s) Milton J. Cohen

It is certified that error appears in the above-identified patent and that said Letters Patent are hereby corrected as shown below:

Add Fig. 6 which was omitted from the issued patent

FIG. 6

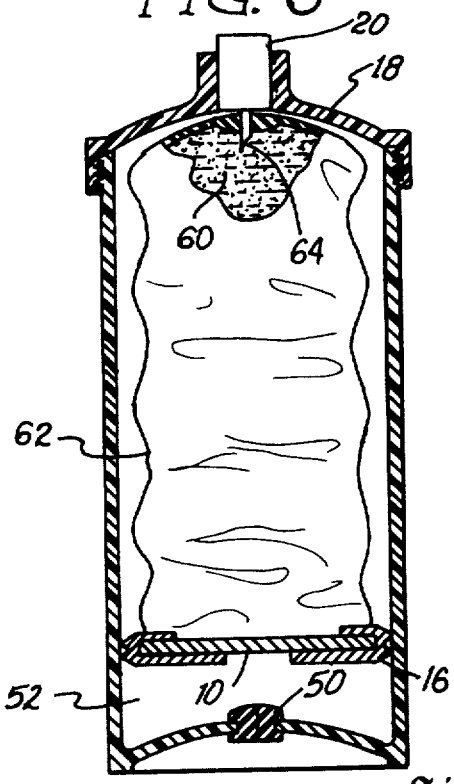

Signed and Sealed this

Fifth Day of April 1977

[SEAL]

*Attest:*

RUTH C. MASON
*Attesting Officer*

C. MARSHALL DANN
*Commissioner of Patents and Trademarks*